US007328530B2

(12) United States Patent
Griffin

(10) Patent No.: US 7,328,530 B2
(45) Date of Patent: Feb. 12, 2008

(54) BARREL LATCH LOCKING DEVICE

(75) Inventor: Todd Griffin, Miami, FL (US)

(73) Assignee: R/M Equipment, Inc., Miami, FL (US)

( * ) Notice: Subject to any disclaimer, the term of this patent is extended or adjusted under 35 U.S.C. 154(b) by 157 days.

(21) Appl. No.: 10/530,732

(22) PCT Filed: Oct. 10, 2003

(86) PCT No.: PCT/US03/32312

§ 371 (c)(1),
(2), (4) Date: Feb. 15, 2006

(87) PCT Pub. No.: WO2004/033981

PCT Pub. Date: Apr. 22, 2004

(65) Prior Publication Data

US 2006/0201044 A1 Sep. 14, 2006

Related U.S. Application Data

(60) Provisional application No. 60/417,491, filed on Oct. 10, 2002.

(51) Int. Cl.
*F41C 27/06* (2006.01)

(52) U.S. Cl. ..... 42/105; 42/75.02

(58) Field of Classification Search ..... 42/75.02, 42/105

See application file for complete search history.

(56) References Cited

U.S. PATENT DOCUMENTS

| | | | | |
|---|---|---|---|---|
| 3,332,162 | A * | 7/1967 | Martwick et al. | 42/105 |
| 3,365,828 | A * | 1/1968 | Badali et al. | 42/105 |
| 3,561,149 | A * | 2/1971 | Center | 42/41 |
| 3,967,402 | A * | 7/1976 | Cooksey | 42/10 |
| 6,397,505 | B1 * | 6/2002 | Stratton et al. | 42/47 |
| 6,481,145 | B2 * | 11/2002 | Weichert et al. | 42/105 |

* cited by examiner

*Primary Examiner*—Troy Chambers
(74) *Attorney, Agent, or Firm*—Nawrocki, Rooney & Sivertson, P.A.

(57) ABSTRACT

A barrel latch safety for a grenade launcher having a barrel slidable upon a receiver via actuation of a barrel latch is provided. The barrel latch safety includes a locking plate and elongate member extending from a portion thereof so as to define a crotch between the elongate member and a side edge of locking plate. The subject safety is adapted to be positioned on their receiver such that a surface adjacent the side edge of the locking plate prohibits barrel latch actuation upon translation of the safety relative to the receiver.

15 Claims, 4 Drawing Sheets

BARREL LATCH LOCKING DEVICE

This is a regular application filed under 35 U.S.C. §111(a) claiming priority under 35 U.S.C. §119(e) (1), of provisional application Ser. No. 60/417,491, having a filing date of Oct. 10, 2002.

TECHNICAL FIELD

The present invention generally relates to safety devices for firearms, more particularly, to a barrel latch locking mechanism for a grenade launcher barrel latch.

BACKGROUND OF THE INVENTION

Modular weapon systems are well know, perhaps best exemplified by the tactile or assault weapon wherein a host weapon, most commonly a rifle, is readily modified to receive, among other things, a supplemental device, for instance, a grenade launcher. In the context of multi-functional modular weapon systems incorporating grenade launchers, and typified by a variety of assemblies and subassemblies, safe, reliable weapon operation is especially paramount.

An exemplary launcher for discussion is the Colt® M203 grenade launcher, a lightweight, single-shot, breech-loaded 40 mm weapon designed especially for attachment to the M4 carbine and the M16A2/A4 rifle. It creates a versatile combination weapon system capable of single round firing both 5.56 mm rifle ammunition as well as the complete range of 40 mm high explosive and special purpose ammunition. This launcher, as well as other commercially available launchers, is readily adapted, for instance via use of a variety of known rail attachment systems and the like, for receipt by various host weapons, e.g., submachine gun, shotgun or folding-stock pistol frame as a mounting platform, in addition to the M4 and M16A2/A4.

Launchers generally include a barrel, a receiver, a modified hand guard, a site (e.g., a leaf or quadrant site), and a rail, interbar or pistol frame. A complete self-cocking firing mechanism, including a barrel latch, a trigger and positive safety lever, is integral to the receiver, allowing the launcher to be operated, not only as a supplemental device, but as a completely independent weapon.

As may be readily appreciated, the barrel latch of the launcher is optimally positioned upon the receiver so as to be within ready reach when gripping the launcher barrel about the handguard (i.e., while supporting the launcher, or entire weapon system as the case may be, as by cradling same with the familiar palm-up hand cupping posture). Upon actuation of the barrel latch, the barrel is free to slide forward upon the receiver so as to accept a round of ammunition, or discharge a casing, and thereafter return to a closed, auto-locking position, ready to fire.

Heretofore, common inadvertent (i.e., unintended) manipulation of the barrel latch of the barrel latch mechanism would disengage the barrel from the remaining portion of the subassembly. Launchers have been known to be retrofitted with a barrel latch guard, more particularly, a shield type obstructing structure which minimizes the potential of barrel disengagement via inadvertent hand placement on, about, or across said barrel latch. Although arguably an improvement, the reliability of such shield has proved less than desirable, being, among other things, cumbersome to manipulate in furtherance of loading a round, and/or ejecting a casing. Thus, there remains a need for a barrel latch safety which is of subtle, reliable design, and is advantageously capable of being easily retrofitted to existing grenade launchers.

SUMMARY OF THE INVENTION

A barrel latch locking device for a grenade launcher barrel latch is provided. The locking device includes a body having opposing end portions, a first opposing end portion of the body including a locking plate. The locking device is adapted to be secured to a grenade launcher receiver proximal to the grenade launcher barrel latch for translation with respect thereto. The arrangement is such that a portion of the locking plate intercepts a travel path for the grenade launcher barrel latch, thereby preventing disengagement of a grenade launcher barrel from the grenade launcher receiver via unintentional actuation of the grenade launcher barrel latch.

More specific features and advantages obtained in view of those features will become apparent with reference to the drawing figures and detailed description of the invention.

DETAILED DESCRIPTION OF THE INVENTION

Figure 1:
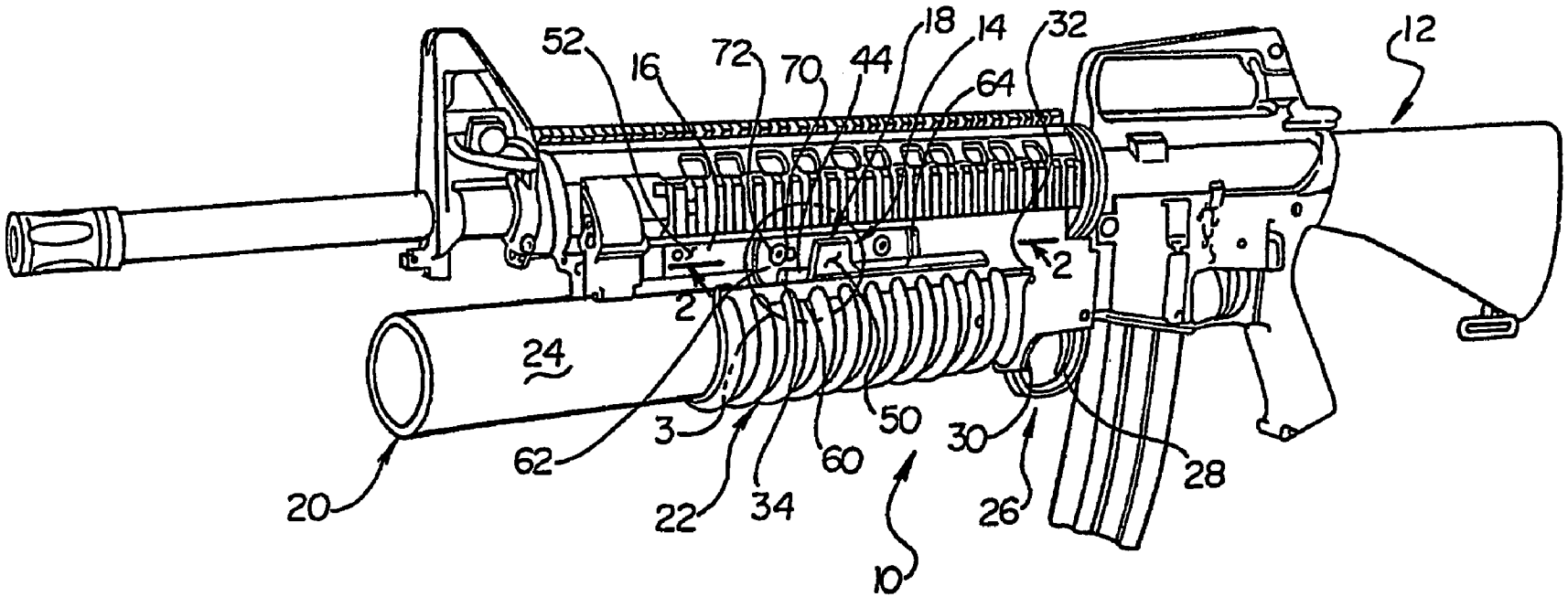
FIG. 1 generally illustrates a weapon system, namely an M16 rifle equipped with a grenade launcher, the barrel latch locking device of the subject invention affixed to a receiver of the launcher and in operative engagement with the barrel latch thereof (i.e., "lock-on")

With general reference to FIG. 1, there is shown a Colt® M203 grenade launcher 10, operatively integrated with an M16 rifle 12, equipped with the barrel latch locking device 14 of the subject invention. The barrel latch locking device 14 is shown affixed to a receiver 16 of the launcher 10, and in operative engagement with a barrel latch 18 thereof (i.e., a "lock-on" condition). It is to be understood that the barrel latch locking device of the subject invention is not limited to operative engagement with the launcher of FIG. 1.

As shown, the grenade launcher 10 generally includes a barrel 20 supported, suspended, or otherwise engaged with the receiver 16 thereof. A handguard 22 substantially extends about a portion of the exterior surface 24 of the barrel 20. The launcher 10, more particularly the receiver 16, further includes, a firing mechanism 26 comprising the barrel latch 18, trigger 28, and trigger safety 30. As is well known, the barrel 20 of the launcher 10 is disengagable from the receiver 16, more particularly a breech end 32 thereof, for translation with respect thereto, in furtherance of loading a munition, and/or discharging a casing of a munition.

The subject barrel latch locking device 14 is adapted to be secured to the launcher receiver 16 proximal to the launcher barrel latch 18, for translation with respect thereto, such that a latch receiving surface 34 thereof selectively intercepts a travel path for the launcher barrel latch 18, thereby preventing disengagement of the launcher barrel 20 from the launcher receiver 16 via unintended actuation of the launcher barrel latch 18. Prior to a detailed discussion of the structure, features and functionality of the subject barrel latch locking device, a discussion of the barrel latch structure and functionality is warranted.

Figure 4:
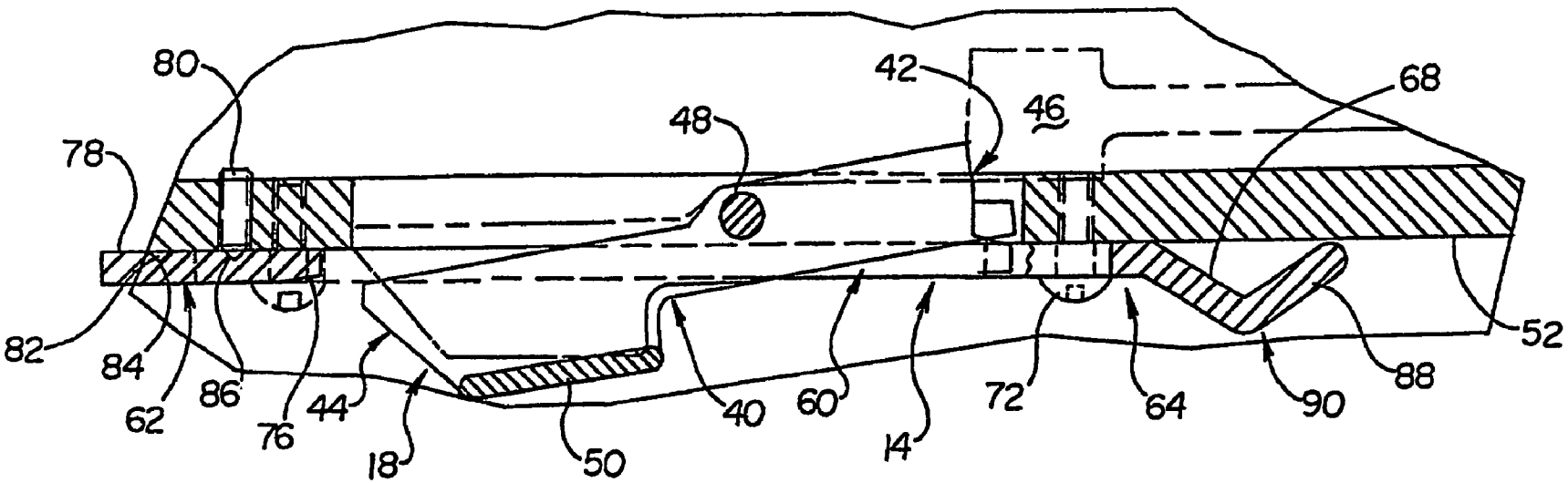

With reference to FIG. 4, the barrel latch 18 of the grenade launcher 10 generally comprises an elongate member (e.g., a bar) 40 having a latch or latching surface 42 opposite a free end 44 thereof, the latch surface 42 intended to selectively engage a portion (e.g., a stop) 46 of the launcher barrel 20, as shown. The barrel latch 18 is pivotably secured by a shaft or pin 48, between its ends, to the launcher receiver 16 such that a portion of the free end 44 (i.e., an actuation surface 50) outwardly projects from a lateral surface (e.g., a sidewall) 52 of the receiver 16 (i.e., the actuation surface 50 is accessible for manipulation of the latch 18). Pivoting of the barrel latch 18 about a pivot axis of the shaft 48, as by "pushing" the actuation surface 50 of the free end 44 into closer proximity to the sidewall 52 of the launcher receiver 16, frees the latch surface 42 from engagement with the stop 46 of the launcher barrel 20 (note ghost lines indicating a disengaged condition for the barrel latch 18), thereby permitting translation of the barrel 20 relative to the receiver 16.

Figure 2:
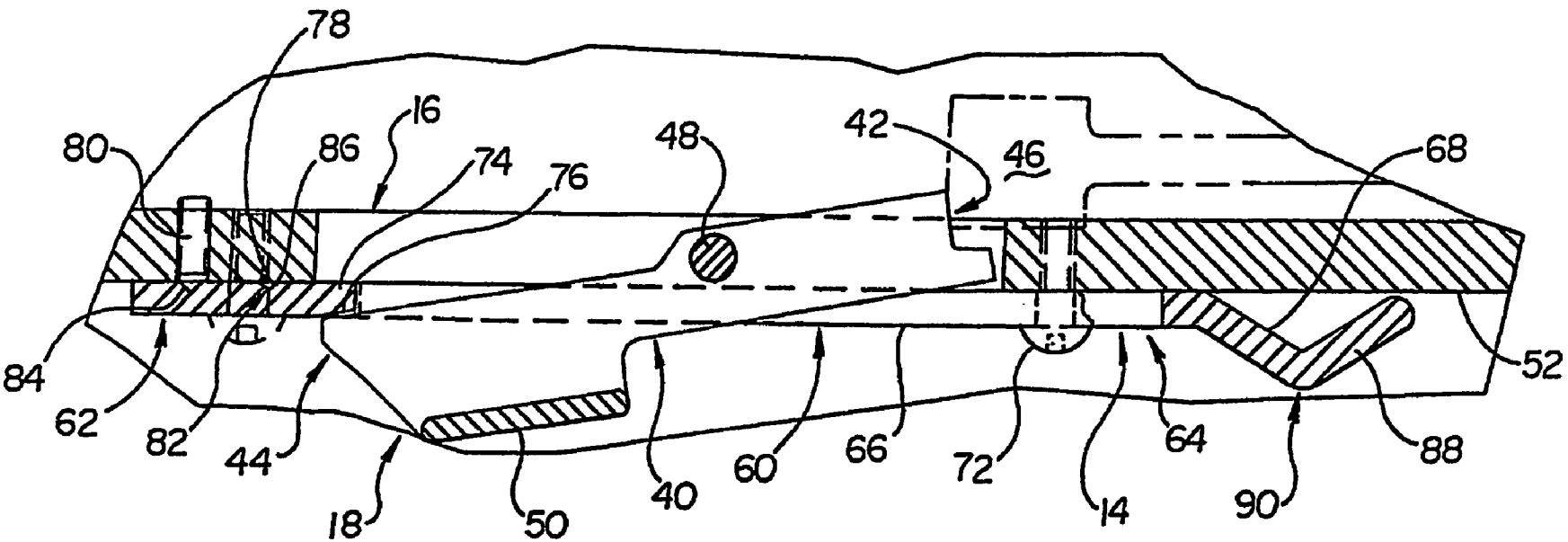
FIG. 2 is a sectional view taken along line 2-2 of FIG. 1 illustrating the interrelationships between components of the subject barrel latch locking device and the barrel latch.
Figure 3:
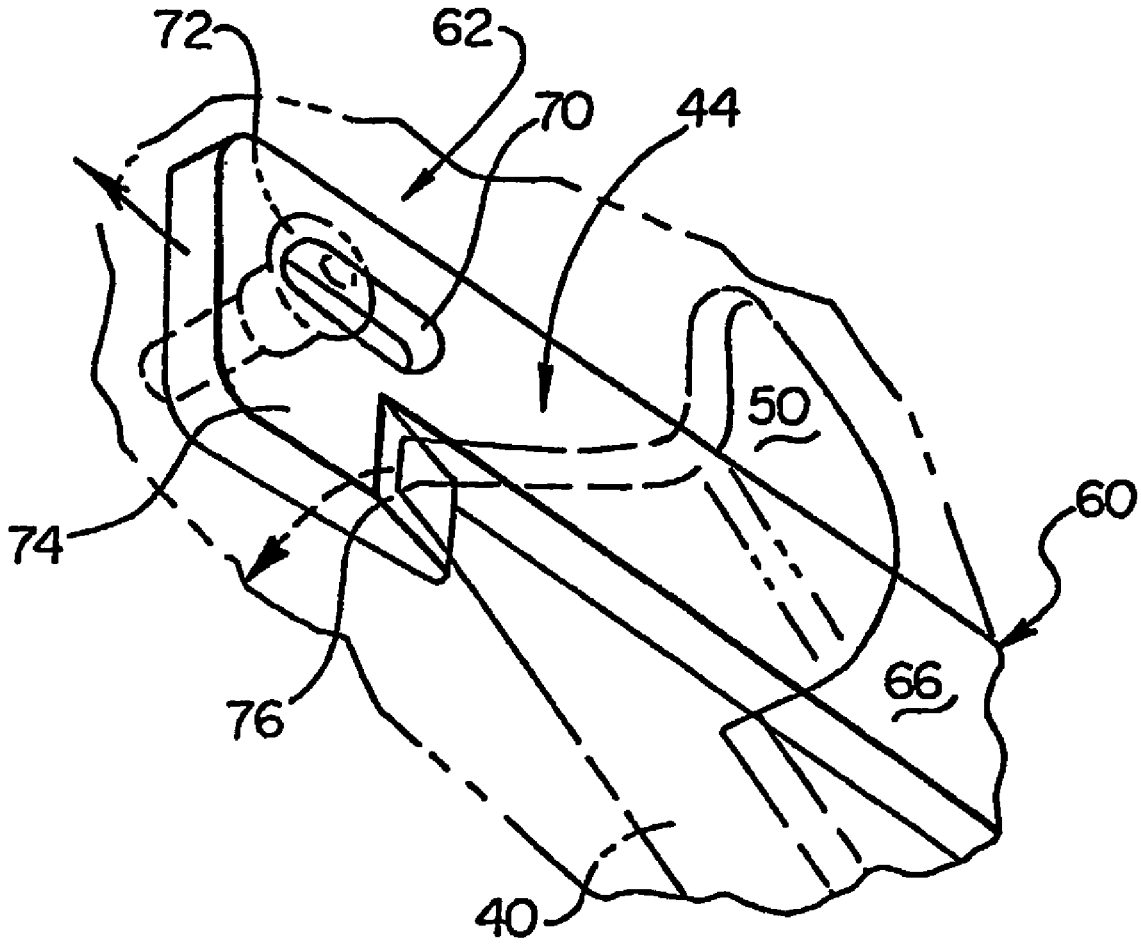
FIG. 3 is a detailed view of the circumscribed area of FIG. 1 illustrating a portion of the barrel latch received upon a latch receiving surface of the subject device; and, FIG. 4 is a view similar to that of FIG. 2, the subject barrel latch locking device disengaged from the barrel latch (i.e., "lock-off").

With general reference now to FIGS. 1-3, the barrel latch locking device generally comprises a body 60 having opposing end portions, more particularly, first 62 and second 64 opposing end portions, for the sake of convention, muzzle and breech end portions respectively, the first opposing end portion 62 of the body 60 being "forward" of the second opposing end portion 64. The device body 60 further, and generally, includes opposing surfaces, namely, first 66 (i.e., visible) and second 68 (i.e., non-visible) surfaces, see e.g., FIG. 2.

Each opposing end portion 62, 64 of the device body 60 preferably includes an aperture or slot 70 to facilitate affixation and retention of the device 14 to the launcher receiver 16, using, as shown, shouldered fasteners 72, or the like. With such arrangement, and based upon the convention adopted herein, the second surface 68 of the device body 60 will be, or is, adjacent the sidewall 52 of the receiver 16, more particularly, an exterior surface of same, see e.g., FIG. 2. The apertures 70 are advantageously configured to permit translation of the locking device 14 upon the fasteners 72, and thereby the receiver 16, namely, between the lock-on (FIG. and lock-off configurations of FIGS. 2 & 4 respectively. One such non-limiting aperture configuration, namely an oval, is shown in FIG. 3, a maximum dimension thereof extending between the opposing end portions 62,64 of the device body 60.

With continued reference to FIGS. 1-3, especially FIG. 3, the first opposing end portion 62 of the device body 60 generally includes a locking plate or blade 74 having a first surface, more particularly, a visible latch receiving surface 76 adapted to operatively engage the free end 44 of the barrel latch 18. A second, non-visible surface 78 of the locking plate 74 (see e.g., FIGS. 2 & 4), opposite the first surface 76, is adapted to seat a detent 80 (e.g., a pin or ball) carried by the sidewall 52 of the receiver 16. More particularly, the non-visible surface 78 of the locking plate 74 includes a pair of spaced apart dimples 82 for receipt and seating of the detent 80 at either a first 84 (FIG. 2) or second 86 (FIG. 4) position of the second surface 78 of the locking plate 74, that is to say, the lock-on and lock-off positions respectively.

The latch receiving surface 76, preferably, but not necessarily, includes a ramped (e.g., beveled) portion so as to provide a sure interference fit for the locking device 14 relative to the barrel latch 18. As will later be detailed, the ramped portion of the latch receiving surface 76 may be effectively wedged between the free end 44 of the barrel latch 18 and the sidewall 52 of the receiver 16 to prohibit actuation of the barrel latch 18.

With reference now especially to FIGS. 1 & 2, the second opposing end portion 64 of the device body 60 preferably, as shown, has a segment configured so as to define a finger rest or grip 88. More generally, the second opposing end portion 64 of the device body 60 is to include a structure to facilitate translation (i.e., actuation) of the device 14 between the lock-on/lock-off conditions of FIGS. 2 & 4 respectively. The subject disclosure is in no way intended to be limiting of the means available to perform the recited function. For instance, the second opposing end portion 64 of the device body 60 may include a protuberance or the like, integral therewith (e.g., a ridge), or attachable thereto (e.g., a knob). Preferably, and advantageously, a terminal end 90 of the second opposing end portion 64 of the device body 60 is configured to include a curve, bend, fold, crease, etc. (i.e., the terminal end 90 is not planar, or alternately stated, a substantial portion of the non-visible surface of the terminal end 90 of the second opposing end portion 64 does not contact the receiver sidewall 52). A not insubstantial amount of force must be imparted to the second opposing end portion 64 of the device body 60 so as to overcome the detent positioning of the device 14 relative to the receiver 16, whether in the lock-on or lock-off position/condition. Thus, a finger rest or hold 88 of large surface area is advantageous, and therefore desirable.

Operation of the subject device is best appreciated by comparison of FIGS. 2 & 4. In the lock-on position of FIG. 2, the latch receiving surface 76 of the locking plate 74 is interposed between a portion of the free end 44 of the elongate member 40 of the barrel latch 18, and the sidewall 52 of the launcher receiver 16, and operatively retained in such condition due to receipt of the receiver detent 80 in the forward most dimple 82 of the non-visible surface 78 of the locking plate 74. Pivot motion of the barrel latch 18, and disengagement of the barrel 20 relative to the receiver 16 thereby, is prohibited.

To attain the lock-off position of FIG. 4 from the lock-on position of FIG. 2, an operator need only apply forward pressure to the finger hold or rest 88 of the second opposing end portion 64 of the device body 60, so as to overcome the bias force of the detent 80 within the forward most dimple 82 of the non-visible surface 78 of the locking plate 74. Upon such manipulation, the subject locking device 14 forwardly slides such that the latch receiving surface 76 of the locking plate 74 is "clear" of the travel path of the free end 44 of the barrel latch 18, the detent 80, seated in the rearward dimple 82, retaining the device body 60 in the lock-off position. By the aforementioned structures, their interrelationship, and their relationship(s) with the launcher components, unintended, inadvertent actuation of the grenade launcher barrel latch is achieved in an efficient, reliable manner.

This invention disclosure provides preferred locking device configurations, and defines preferred relationships and interrelationships between structures of the configuration, in addition to relationships and interrelationships between the subject device and the grenade launcher. There are other variations of this invention which will become obvious to those skilled in the art. It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claim.

What is claimed is:

1. A barrel latch locking device for a grenade launcher barrel latch, said locking device comprising a body having opposing end portions, a first opposing end portion of said body includes a locking plate, said locking device adapted to be secured to a grenade launcher receiver proximal to the grenade launcher barrel latch for translation with respect thereto such that a portion of said locking plate intercepts a travel path for the grenade launcher barrel latch, thereby preventing disengagement of a grenade launcher barrel from the grenade launcher receiver via unintentional actuation of the grenade launcher barrel latch.

2. The locking device of claim 1 wherein said locking plate includes a first surface, and a second surface opposite said first surface.

3. The locking device of claim 2 wherein a portion of said first surface of said locking plate includes a barrel latch receiving surface.

4. The locking device of claim 3 wherein said barrel latch receiving surface includes a ramped portion.

5. The locking device of claim 3 wherein said second surface of said locking plate is adapted to cooperatively engage a portion of the grenade launcher receiver so as to resist translation.

6. The locking device of claim 5 wherein said second surface of said locking plate is adapted to seat a detent.

7. The locking device of claim 6 wherein said second surface of said locking plate is adapted to seat a detent at first and second positions with respect thereto.

8. The locking device of claim 7 wherein said second surface of said locking plate includes spaced apart dimples.

9. The locking device of claim 8 wherein said spaced apart dimples correspond to said first and second positions of said second surface of said locking plate.

10. The locking device of claim 5 wherein a second end portion of said elongate member is configured to facilitate translation of said locking device.

11. The locking device of claim 10 wherein a second end portion terminates in a finger rest.

12. The locking device of claim 5 wherein a second opposing end portion of said body includes means for actuating said device between a lock-on and a lock-off position.

13. The locking device of claim 10 wherein each opposing end portion of said opposing end portions of said body includes a slot.

14. A barrel latch safety for a grenade launcher having a barrel slidable upon a receiver via actuation of a barrel latch, said safety comprising a locking plate and an elongate member extending from a portion thereof so as to define a crotch between said elongate member and a side edge of said locking plate, said safety adapted to be positioned on the receiver, a surface adjacent said side edge of said locking plate capable of prohibiting barrel latch actuation upon translation of said safety relative to the receiver.

15. A grenade launcher comprising:

a. a barrel in operative engagement with a receiver assembly, said receiver assembly including a barrel latch for securing said barrel in an operable position relative to said receiver assembly; and, b. a barrel latch lock, selectively positionable on said receiver assembly in furtherance of locking-out said barrel latch, comprising a latch block for prohibition of actuation of said barrel latch.

* * * * *